United States Patent [19]

Van der Graaf

[11] 4,363,567

[45] Dec. 14, 1982

[54] MULTIPLE BORE MARINE RISER WITH FLEXIBLE REINFORCEMENT

[75] Inventor: Gerhardus C. Van der Graaf, The Hague, Netherlands

[73] Assignee: Shell Oil Company, Houston, Tex.

[21] Appl. No.: 176,606

[22] Filed: Aug. 8, 1980

[30] Foreign Application Priority Data

Sep. 12, 1979 [GB] United Kingdom ..... 7931625

[51] Int. Cl.[3] ..... E21B 17/01

[52] U.S. Cl. ..... 405/195; 166/367; 405/202

[58] Field of Search ..... 405/169, 195, 202, 224; 114/264, 265; 166/350, 367

[56] References Cited

U.S. PATENT DOCUMENTS

| | | | |
|---|---|---|---|
| 3,324,943 | 6/1967 | Price | 166/350 X |
| 3,355,899 | 12/1967 | Koonce et al. | 405/202 |
| 3,978,804 | 9/1976 | Beynet et al. | 405/224 |
| 4,114,393 | 9/1978 | Engle et al. | 114/264 |
| 4,198,179 | 4/1980 | Pease et al. | 405/202 X |
| 4,266,888 | 5/1981 | Bayer et al. | 405/202 |
| 4,273,470 | 6/1981 | Blomsma | 405/202 |

*Primary Examiner*—David H. Corbin

[57] ABSTRACT

A multiple bore marine riser adapted to form a communication between equipment on a floating structure and pipelines on the sea bottom includes flexible reinforcement means to prevent the occurrence of high bending stresses in the flowlines of the riser when the latter is subjected to large bending forces.

9 Claims, 10 Drawing Figures

FIG. 4
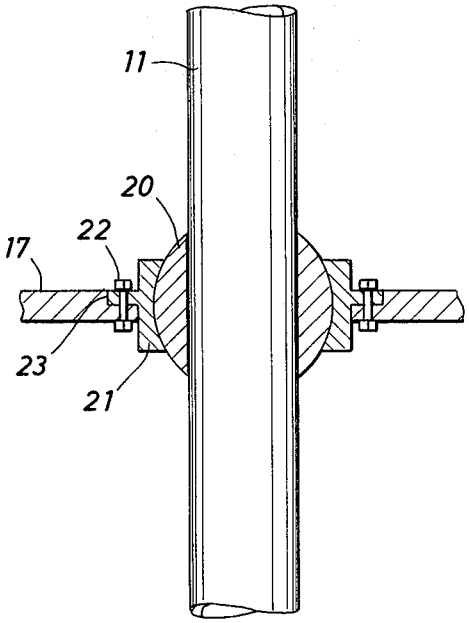
FIG. 5
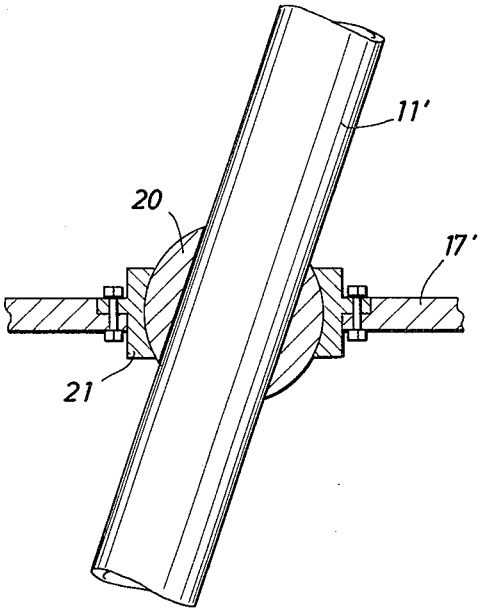
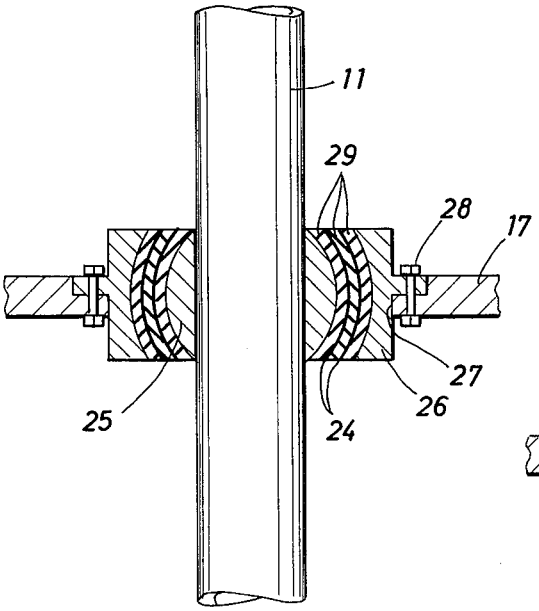
FIG. 6
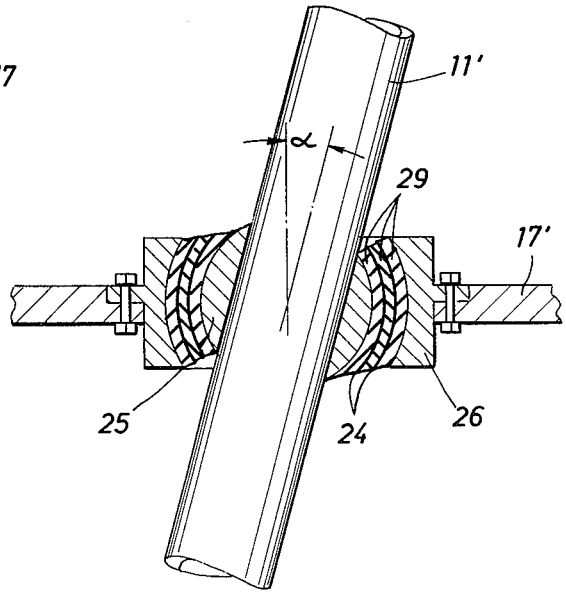
FIG. 7

FIG. 8
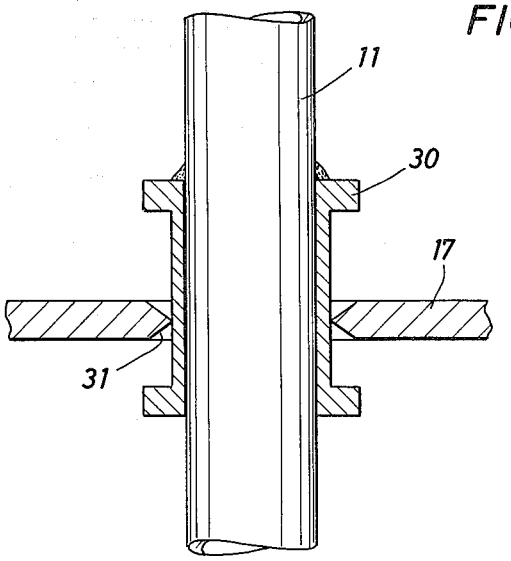
FIG. 9
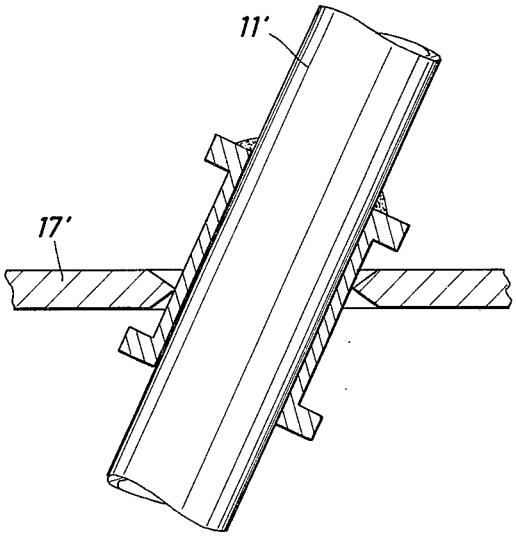
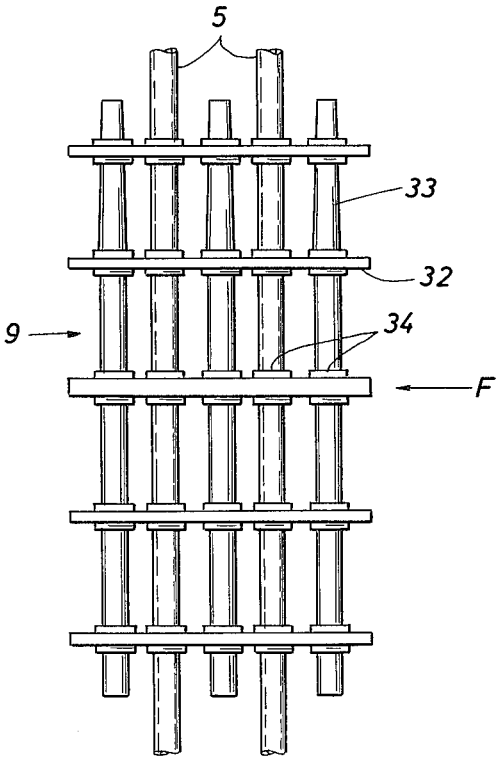
FIG. 10

MULTIPLE BORE MARINE RISER WITH FLEXIBLE REINFORCEMENT

BACKGROUND OF THE INVENTION

The present invention relates to a multiple bore marine riser with a flexible reinforcement. Marine risers are applied in marine oilfield operations to provide a fluid communication between a well or a pipeline situated on or near the sea or ocean obttom, and a structure that is floating at the water level above the well or pipeline. A multiple bore marine riser consists of an assembly of parallel flowlines co-operating with a base member. The top of the marine riser is tensioned in vertical direction to obviate buckling of the flowlines and to reduce bending stresses in the flowlines which stresses result from the combined action of the waves, the water current and the displacement of the floating structure from the position thereof vertically above the base member. The flowlines may be used for various purposes, such as for the transport of fluids (such as oil or gas) from a well (or pipeline) to the floating structure, for the injection of fluids (such as gas or water) from the floating structure into a submerged well or plurality of submerged wells, for pumping fluids from the floating structure to a loading buoy or to shore, for carrying out "through-the-flowline" (TFL)-operations, wherein equipment is pumped to the well (and retrieved therefrom) by means of TFL-techniques, for flushing liquids through flowlines before disconnecting the multibore marine riser, and for supplying pressure fluids to submerged control equipment for operation submerged valves, couplings, etc. on the wellhead.

The present invention relates in particular to a multibore marine production riser with flexible reinforcement, wherein the flowlines are made of metal, such as steel. The flexible reinforcement is suitable for application at locations of the multibore marine riser where this riser is exposed from time to time or continuously to large bending forces. One such location is at the lower end of the multibore marine riser where the riser is connected to a base member that is anchored to the sea bottom, as shown in U.S. Pat. No. 3,605,413. Also, large bending forces can be expected to be exerted on the marine riser at the location where the latter may incidentally come into contact with the floating structure that supports the upper end of the marine riser, as shown in U.S. Pat. No. 3,602,319. The flexible reinforcement according to the invention may also find useful application at these locations.

It will be appreciated that damage of the marine riser by such large bending forces should be prevented in order to lengthen the operational life of the marine riser.

In a prior art construction designed for reducing bending moments in a multiple bore marine riser, each flowline is connected to fluid communication means on the base member by means of an elastomeric flexjoint. A drawback, however, is that angles of significant value between the parts of each flexjoint will prohibit the use of tools that are transported through the flowlines into the well and vice-versa, such as is done in "through-the-flowline" (TFL) operations.

In another prior art construction, the lower ends of the assembly of flowlines are rigidly connected substantially perpendicularly to the base member. The flowlines are guided through guide rings that are carried by a centrally arranged conduit of larger cross-section than the flowlines, which conduit is coupled to the base member by means of a universal elastomeric flexjoint. At lateral displacements of the conduit, the main axial load is taken up by this conduit and the guide rings carried thereby curve the individual flowlines according to a large bending radius as a result whereof relatively low bending stresses will be induced in the flowlines. The axial loads in the flowlines are relatively small, but sufficient to prevent buckling of the flowlines. The large bending radii of the flowlines allow the application of all TFL-operations. However, in a number of applications of a multiple bore marine riser, there is no use for the large-diameter flowline that is applied in this design for taking up the axial load. The presence of the load-carrying conduit is not present and the flowlines share the axial load exerted on the riser assembly.

Another object of the invention is a multiple bore marine riser provided with reinforcement means that protect the riser from being damaged by the floating structure from which it is suspended, when this structure is subjected to large displacements from the position thereof vertical above the base member to which the lower end of the riser is connected.

SUMMARY OF THE INVENTION

The multiple bore marine riser according to the invention includes a plurality of parallel flowlines, an assembly of rods extending parallel to the assembly of flowlines over at least part of the length thereof, the sum of the moments of inertia of the individual flowlines and rods varying along the length of the assembly of rods, and a plurality of spacer plates arranged between the assemblies of flowlines and rods, the individual rods and flowlines being attached to the plates by coupling means allowing a pivotal movement of the flowlines and the rods with respect to the plates.

When the assembly of rods is arranged near the lower end of the assembly of flowlines at the location where these flowlines are in fluid communication with fluid conduits on a base member anchored to the sea or ocean bottom, the lower ends of the rods as well as the lower ends of the flowlines are rigidly connected to the base member. The sum of the moments of inertia of the individual flowlines and rods is then chosen to decrease in a direction away from the base member. Any lateral displacement of the assembly of flowlines that generates a bending moment in the flowlines near the base member, will then not result in a curvature of these lines that is restricted to a location close to the base member, but in a smooth curvature extending over the part of the flowlines along which the rods extend. As a result hereof the flowlines will be subjected to a relatively low bending stress. Or in other words, a maximum deflection of the flowlines at a level just above the upper level of the rods will result in a minimum bending stress in the flowlines.

In an alternative manner, the assembly of rods can be arranged along a part of the flowlines that may incidentally be subjected to bending stresses as a result of contact with parts of the floating structure that supports the multiple bore marine riser. The sum of the moments of inertia of the individual flowlines and rods is then chosen to decrease in two directions away from the middle of the assembly of rods. This middle of the assembly of rods is preferably at the same level at which the riser will incidentally come into contact with the floating structure (or any other body or structure).

In particular, good results will be obtained if the variation of the sum of the moments of inertia of the individual flowlines and rods over the length of the assembly of rods is chosen such that the rods (and consequently also the flowlines) obtain a substantially constant radius of curvature over the length of the rods when the flowlines are subjected to lateral loads.

It is observed that the individual flowlines and rods of the two assemblies are coupled to the spacer plates in such a manner that substantially no bending moments can be transferred between the flowlines and the rods. The transfer of forces between the flowlines on the one side and the rods on the other side is substantially restricted to planes perpendicular to the axes of the flowlines and rods when these are in a straight position. Some embodiments of couplings suitable for this purpose will be described hereinafter.

BRIEF DESCRIPTION OF THE DRAWING

A multiple bore marine riser with a flexible reinforcement according to the invention will be described by way of example in more detail with reference to the drawings, in which:

FIG. 4 shows—on a larger scale than FIG. 3—a section of the spacer plate of FIG. 3 (taken over the section IV—IV thereof) showing the coupling of a rod with the spacer plate.

FIG. 5 shows the coupling of FIG. 4 in a different angular position.

FIGS. 6 and 7 show an alternative of the coupling means of FIG. 4 in two different positions.

FIGS. 8 and 9 show another alternative of the coupling means of FIG. 4 in two different positions; and FIG. 10 shows schematically on a larger scale than FIG. 1 a side view of the upper flexible reinforcement of the riser of FIG. 1.

DESCRIPTION OF A PREFERRED EMBODIMENT

Figure 1:
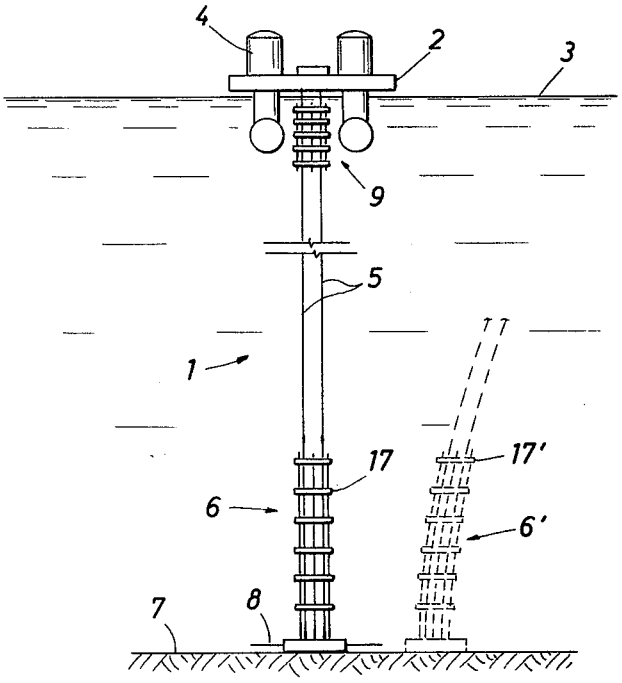
FIG. 1 shows schematically a side view of a multibore production riser.

FIG. 1 shows a side view of a multiple bore production riser 1 supported from a floating platform 2 floating at the sea level 3. The floating platform 2 is a production platform and carries production equipment 4, which equipment is in communication with the individual flowlines 5 of the riser 1.

The lower end of the multiple bore production riser 1 is provided with a lower flexible reinforcement 6, which will be described hereinafter in greater detail with reference to FIGS. 2 and 3. The lower ends of the riser and the reinforcement are anchored to the sea bottom 7, and to one or more pipelines 8 that communicate at one end thereof with the metal flowlines of the riser run to various locations such as a plurality of submerged wellheads (not shown).

It will be appreciated that although the platform 2 is provided with means to maintain it in a position substantially vertically above the location where the lower end of the riser 1 is anchored to the sea bottom, lateral displacements from such position will take place, which displacements will force the reinforcement 6 to be bent (see position 6' of the reinforcement shown in phantom in FIG. 1). Even if the platform can be maintained at the desired location, underwater currents and waves may be present that load the riser 1 such that bending of the flexible reinforcement 6 will take place.

Further, excessive bending of the upper end of the multiple bore marine riser 1 may occur when this upper end comes into contact with parts of the floating platform 2. To reduce the bending stresses in this part of the riser 1 under such conditions, the upper part of the riser is provided with an upper flexible reinforcement 9. This reinforcement is shown in greater detail in FIG. 10 of the drawings.

Figure 2:
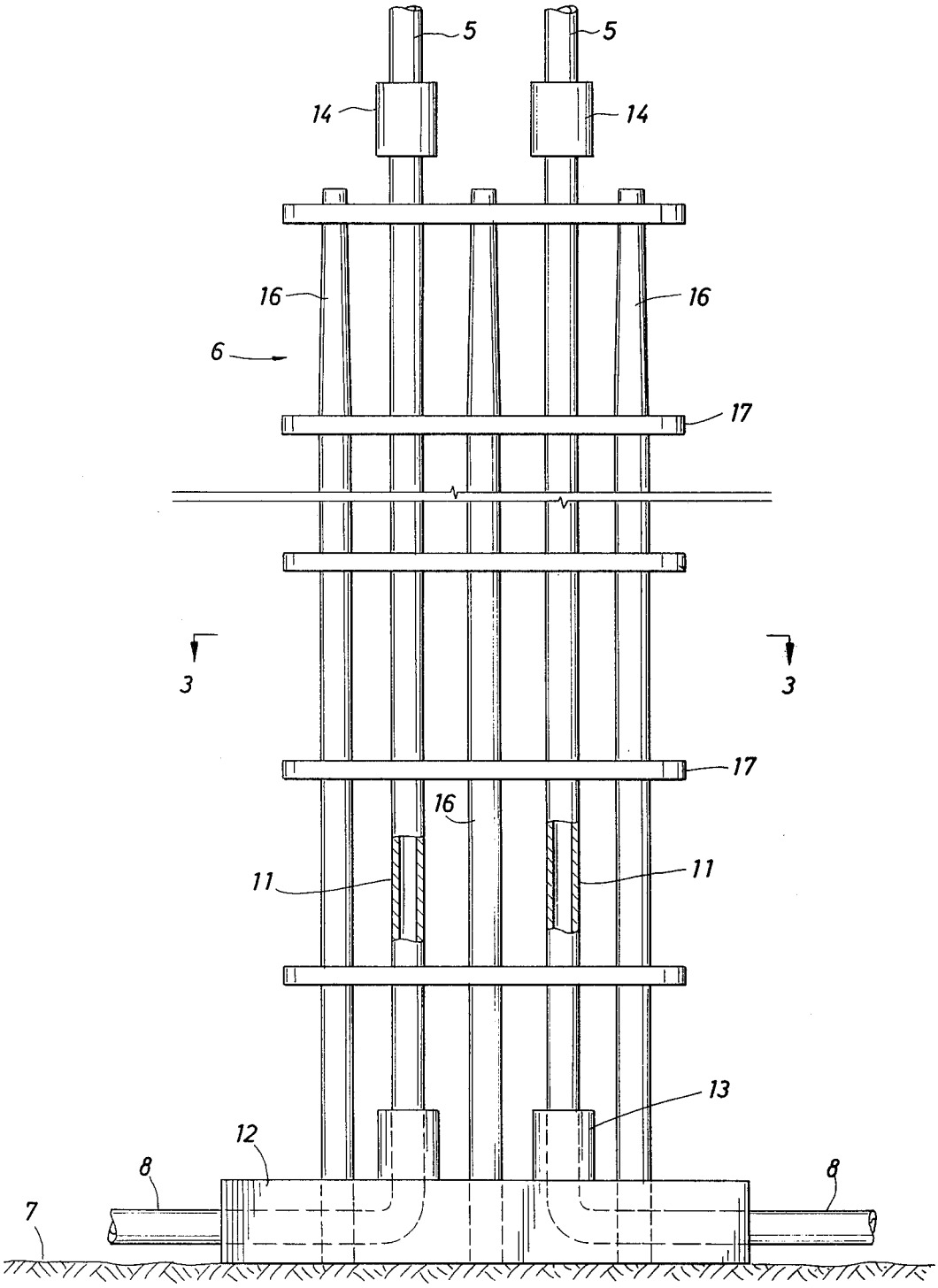
FIG. 2 shows schematically on a larger scale than FIG. 1 a side view of the lower flexible reinforcement of the riser of FIG. 1.

FIG. 2 shows the flexible reinforcement 6 of FIG. 1 in greater detail. The reinforcement 6 is in an upright or straight position. The metal flowlines 11 that form extensions of the flowlines 5 of the riser 1 are at the lower end thereof coupled to the base member 12 by means of couplings 13. The base member is anchored in a manner known per se (such as by not shown anchor piles) to the sea bottom 7. The couplings 13 are known per se and therefore not described in detail. These couplings 13 prevent the lower parts of the flowlines to obtain a position at an angle other than 90° with respect to the base member. Each coupling 13 thus forms a rigid connection between a flowline and the base member, such that the lower end of the flowline is rigidly and substantially perpendicularly positioned with respect to the base member 12 and to the sea bottom 7.

The upper end of each flowline 11 is coupled by coupling means 14 to the lower end of a flowline 5 of the multibore marine production riser 1. Such coupling means are known per se and are therefore not described in detail. To prevent buckling of the flowlines 5, the flowlines are axially tensioned by tensioning means on the platform 2. Tensioning means for tensioning risers or flowlines in marine operations such that variations in the tensional loads, which variations originate from vertical movements of the floating platform are substantially compensated, are known per se and therefore not described herein.

Figure 3:
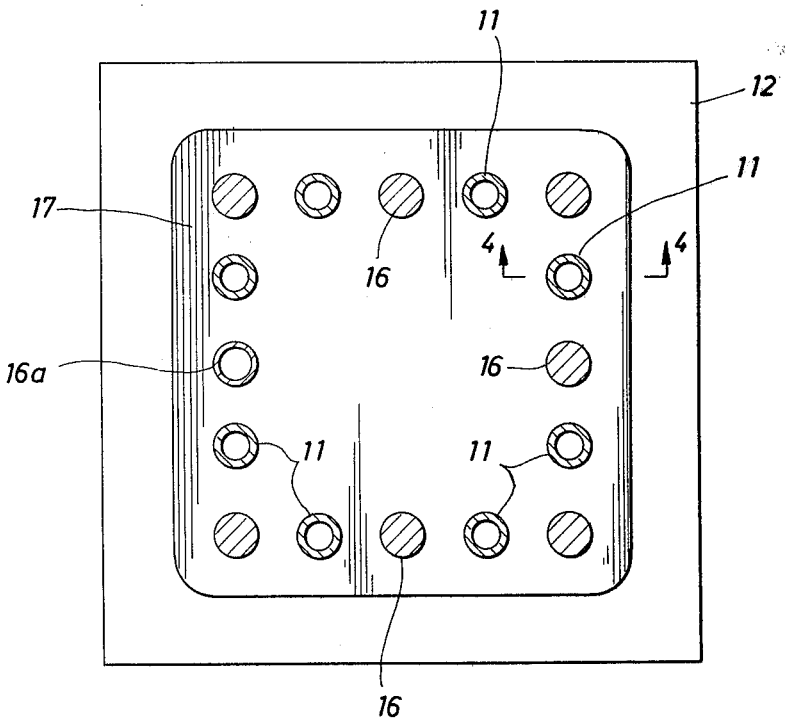
FIG. 3 shows a top view of a spacer plate of the flexible reinforcement of FIG. 2 taken over the section III—III thereof.

The flexible reinforcement 6 further comprises a plurality of metal rods 16 (such as steel rods) that are placed in between the flowlines 11 of the reinforcement in a manner that can best be seen in FIG. 3 of the drawings. The lower ends of the rods 16 are rigidly connected to the base member 12. Spacer plates 17 are arranged at various locations along the length of the rods 16 for coupling the assembly of rods 16 to the assembly of flowlines 11. Coupling means (that will be described hereinafter in greater detail with reference to FIGS. 4, 5; 6, 7; and 8, 9 of the drawings) are arranged between the rods and flowlines and the spacer plates. Each coupling means allows a pivotal movement between a spacer plate and the flowline (or rod) with which it co-operates. Within the range of pivotal movements that a flowline (or rod) is expected to make with respect to the spacer plate, the coupling means cannot transfer any bending moments between the flowlines and the rods via the spacer plates. By the use of pivotal coupling means between the flowlines and rods and the spacer plates, the spacer plates 17 will remain parallel to one another when the flowlines are bent (see FIG. 1). Consequently, the curvatures of those parts of all the flowlines and all the rods within the flexible reinforcement 6 will be identical to each other, and be dictated by the sum of the moments of inertia of the individual flowlines and rods at the various horizontal levels of the flexible reinforcement 6. Since this sum of moments of inertia decreases in a direction away from the base 12, the flowlines will be curved over the total height of the flexible reinforcement 6. The bending stress in the flowlines will then be relatively low. The lowest bending stress will be obtained if the sum of the moments of inertia is chosen such that the flowlines (and the rods) obtain a curvature with constant radius.

In the embodiment of FIG. 2, the flowlines 11 have a constant diameter (and consequently a constant moment of inertia over the height thereof) whereas the rods 16 have a diameter that decreases in upward direction. It will be appreciated, however, that in an alternative embodiment, the flowlines 11 may be designed to have a moment of inertia that decreases in upward direction; and the rods have either a constant or a decreasing diameter in upward direction. The decrease in diameter of the flowlines and/or of the rods may be either of a gradual or of a stepwise nature.

Some types of pivotal coupling means that are suitable for use in the present invention for joining the flowlines and the spacer plates as well as for joining the rods and the spacer plates will now be discussed with reference to FIGS. 4, 5; 6, 7; and 8, 9 of the drawings.

The pivotal coupling means that is schematically shown in FIG. 4 is a ball-and-socket joint including a ball 20 that is connected to a flowline 11, and a socket 21 that is connected by means of bolts and nuts 22 to an opening 23 of a spacer plate 17.

FIG. 5 shows the position 11' of the flowline 11 with respect to the position 17' of the spacer plate 17 at an angle other than 90°. The coupling means cannot transfer any bending moments between the flowline and the spacer plate, and the spacer plate therefore remains in a position 17' that is parallel to the original position thereof.

FIG. 6 shows schematically a coupling means that includes a plurality of metal rings 24 that are arranged between a ball 25 connected to a flowline 11, and a socket 26 arranged in an opening 27 provided in the spacer plate 17 and connected thereto by means of bolts and nuts 28.

The rings 24 and the inner wall of the socket 26 are shaped such that they are concentric to the outer surface of the ball 25. The socket, the ball and the rings are interconnected by an elastomeric material 29, such as a rubber vulcanized thereto. The elastomeric material is of sufficient flexibility to substantially prevent the flowline 11 when being bent, to exert a bending moment on the spacer plate 17. The bent flowline (see FIG. 7) thereby obtains a position 11' with respect to the position 17' of the spacer plate at an angle $\alpha$ that differs from 90°.

Finally, FIGS. 8 and 9 show a pivotal joint in two positions, respectively, which joint is formed by a bushing 30 connected to a flowline 11, the bushing cooperating with an opening 31 in the spacer plate 17, the side wall of the opening having a profile that allows only a limited contact with the side wall of the bushing, such that the bushing may slide through the opening and at the same time carry out pivotal movements with respect to the central axis of the opening. FIG. 9 shows the flowline in a position 11' with respect to the spacer plate that is in a position 17' parallel to the original position 17 thereof.

FIG. 10 of the drawings shows schematically a side view of the flexible reinforcement 9 that is suitable for reinforcing a part of the riser 1 on which an external lateral force will incidentally be exerted. The position at which such reinforcement 9 may be applied is shown in FIG. 1. The reinforcement 9 includes a plurality (at least five) spacer plates 32 co-operating with the reinforcing rods 33 and the flowlines 5 through the intermediary of coupling means 34 that allow pivotal movement of the individual rods and flowlines with respect to the spacer plates. The cross-section of each of the rods decreases from the middle thereof towards the ends, such that the sum of the moments of inertia of the individual rods and flowlines decreases in both directions from the middle of the flexible reinforcement 9. Thus, when a force F is exerted laterally with respect to the reinforcement 9 as shown in FIG. 10, the flowlines will be curved over the total height of the reinforcement 9, which results in a relatively low bending stress raised in each of the flowlines.

The invention is not restricted to the use of solid rods as shown in FIGS. 1–3 and 10. Hollow rods of circular cross-section may be used as well, as shown at **16*a* in FIG. 3**.

Further, the invention is not limited to the particular number of flowlines, rods and spacer plates shown in the drawings. Any number of these elements may be used arranged according to any desired pattern, as long as the individual rods and flowlines are so connected to the spacer plates that substantially no bending moments can be transferred between the flowlines and the rods.

Finally, it is observed that the invention may also be applied to multiple bore marine risers wherein the flowlines 5 are directly coupled (without the intermediary of couplings 14) to the corresponding flowlines 11.

I claim as my invention:

1. A multiple bore marine riser including a plurality of parallel flowlines, an assembly of rods extending parallel to the assembly of flowlines over part of the length thereof, wherein cross-sectional diameters of the individual rods vary along the length of the rods, a plurality of rigid horizontal spacer plates arranged between the assemblies of flowlines and rods, said plates being arranged in vertically-spaced relationship to each other over a selected section of the length thereof, and coupling means operatively connecting the individual rods and flowlines to the plates allowing a pivotal movement of the flowlines and the rods with respect to the plates at the coupling means that is about an axis taken normal to the longitudinal axis of the flowlines and rods.

2. The riser according to claim 1, including a base member wherein the lower ends of the rods as well as the lower ends of the flowlines are rigidly connected substantially perpendicular to said base member, said base member being adapted to be anchored to the bottom of a body of water, and wherein the diameter of the rods and the sum of the moments of inertia decreases in a direction away from the base member.

3. The riser according to claim 1, wherein diameters of the rods and the sum of the moments of inertia decreases in both directions away from the middle of the assembly of rods.

4. The riser according to claim 1 including flexible coupling means connecting the flowlines to the spacer plates.

5. The riser according to claim 4 wherein said coupling means includes a plurality of concentric metal rings shaped according to part of a spherical surface, said rings being interconnected by elastomeric material.

6. The riser according to claim 1 wherein a coupling means includes an opening in a spacer plate co-operating with a bushing connected to a flowline or a rod.

7. The riser according to claim 1 wherein the flowlines have a constant diameter and moment of inertia over at least the part thereof that faces the assembly of the rods.

8. The riser according to claim 1 wherein the diameters of the flowlines and the rods vary along portions of the lengths thereof and the variation of the sum of the moments of inertia over the length of the assembly of rods is such that the flowlines and the rods on being bent obtain a curvature of substantially constant radius.

9. The riser according to claim 4 including flexible coupling means connecting the rods to the spacer plates.

* * * * *